US006976732B2

(12) United States Patent
Thomas et al.

(10) Patent No.: US 6,976,732 B2
(45) Date of Patent: Dec. 20, 2005

(54) CONVERTIBLE FURNITURE SYSTEM COMPRISED OF MODULAR CONVERTIBLE BOX FRAMES AND METHODS OF FORMING VARIOUS FURNITURE CONFIGURATIONS THEREFROM

(76) Inventors: David L. Thomas, 18733 Briarwood Dr., Hagerstown, MD (US) 21742; Mark D. Thomas, 13302 Clopper Rd., Hagerstown, MD (US) 21742

( * ) Notice: Subject to any disclaimer, the term of this patent is extended or adjusted under 35 U.S.C. 154(b) by 0 days.

(21) Appl. No.: 10/836,630

(22) Filed: May 3, 2004

(65) Prior Publication Data

US 2005/0253424 A1 Nov. 17, 2005

(51) Int. Cl.[7] ..... A47C 13/00; A47C 17/04; A47B 85/04; A47B 39/00; A47B 85/00

(52) U.S. Cl. ..... 297/1; 297/3; 297/122; 297/124; 297/174 R; 5/3; 5/5; 5/37.1

(58) Field of Search ..... 297/3, 1, 124, 297/122, 174; 108/69, 83, 91, 6, 11, 14; 5/3, 5/5, 7, 37.1, 39; 248/558

(56) References Cited

U.S. PATENT DOCUMENTS

| | | | | |
|---|---|---|---|---|
| 361,688 | A * | 4/1887 | Gebhardt | 108/83 |
| 543,053 | A * | 7/1895 | Ripking | 108/78 |
| 1,757,960 | A * | 5/1930 | Greenstreet | 297/124 |
| 1,798,268 | A * | 3/1931 | Richardson | 108/83 |
| 2,793,679 | A * | 5/1957 | Layne | 297/3 |
| 3,008,782 | A | 11/1961 | Osborne | |
| 3,233,942 | A | 2/1966 | Creutz | |
| 3,672,719 | A * | 6/1972 | Haukedahl | 297/118 |
| 3,744,845 | A | 7/1973 | Sooker | |
| 4,148,264 | A * | 4/1979 | Caravias | 108/145 |
| 4,277,856 | A | 7/1981 | Danin | |
| 4,506,927 | A * | 3/1985 | Lombardo | 297/118 |
| 4,615,559 | A * | 10/1986 | Blondeau | 297/124 |
| 4,801,175 | A * | 1/1989 | Albanese | 297/124 |
| 5,452,951 | A * | 9/1995 | Peller | 312/310 |
| 5,704,683 | A * | 1/1998 | Cooper et al. | 297/124 |
| 5,722,716 | A | 3/1998 | Thomas et al. | |
| 6,135,545 | A | 10/2000 | Liao | |
| 2002/0195029 | A1 * | 12/2002 | Walton | 108/110 |

FOREIGN PATENT DOCUMENTS

| | | |
|---|---|---|
| DE | 3242148 A1 | 8/1984 |
| WO | WO 91/04694 | 4/1991 |

OTHER PUBLICATIONS

WO 91/04694 Hollingsworth, Joe. Apr. 18, 1991.*

* cited by examiner

*Primary Examiner*—Peter R. Brown
*Assistant Examiner*—Sarah C. Burnham
(74) *Attorney, Agent, or Firm*—Nixon & Vanderhye, P.C.

(57) ABSTRACT

Modular convertible furniture systems include a pair of similar open-ended box frame assemblies which are nestable one within the other. A pair of slotted support rails are attached pivotally at respective opposing corners of one of the box frame assemblies so as to be movable between raised and lowered positions. When in a raised position, the rails provide a support for a solid board plank thereby becoming a seat back (e.g., for a chair, love seat, or sofa-type arrangement). When the rails are in a lowered position substantially parallel to the ground, the two box frame assemblies may be oriented back-to-back so as to provide a support for a mattress thereby converting the structure into a bed arrangement, for example. The box frame assemblies can be positioned on different sides and ends thereby allowing formation of tables and/or shelving as may be desired.

9 Claims, 5 Drawing Sheets

CONVERTIBLE FURNITURE SYSTEM COMPRISED OF MODULAR CONVERTIBLE BOX FRAMES AND METHODS OF FORMING VARIOUS FURNITURE CONFIGURATIONS THEREFROM

FIELD OF THE INVENTION

The present invention relates generally to convertible furniture. In a particularly preferred form, the present invention is embodied in a convertible furniture system having frames which may be manipulated and/or reoriented so as to assume various furniture configurations, for example, chair, love seat, sofa and bed, as well as desks and tables of various sizes and configurations.

BACKGROUND AND SUMMARY OF THE INVENTION

Furniture which may be converted between various configurations is highly desirable since one piece of furniture may serve several functions. Such "convertible furniture" is, in and of itself, notoriously well known as evidenced from the following list of patent publications: U.S. Pat. No. 3,008,782 to Osborne; U.S. Pat. No. 3,233,942 to Creutz; U.S. Pat. No. 3,672,719 to Haukedahl; U.S. Pat. No. 3,744,845 to Sooker; U.S. Pat. No. 4,277,856 to Danin; U.S. Pat. No. 4,506,927 to Lombardo; U.S. Pat. No. 6,135,545 to Liao; DE 3242148A1 to Gerhard; and WO 9104694A1 to Hollingsworth. Such convertible furniture is highly desirable since it is capable of accommodating the needs and/or desires of the user.

Recently, in U.S. Pat. No. 5,722,716 to Thomas (the entire content of which is expressly incorporated hereinto by reference), there has been disclosed a novel furniture frame having components which may be manipulated and/or reoriented so that it assumes various furniture configurations. Specifically, the furniture frame according to the '716 patent includes a number of vertical and horizontal tubular sections which are joined to one another so as to form side frames which are separated latitudinally by at least one horizontally disposed cross-support member. A number (e.g., four) detachable L-shaped leg members may be inserted telescopically into the vertical or horizontal tubular components of the side frames and fixed in position, if desired, with the use of conventional pegs, screws, bolts, pins or like fixing elements.

While such prior convertible furniture proposals serve their intended function of providing a single piece of furniture having multiple purposes, some improvement is still needed. For example, it would be highly desirable if a furniture frame could be provided so that any form of furniture may be constructed in dependence upon the user's desires simply by manipulating and/or reoriented one or more components of the frame without necessarily employing securing elements and which can be constructed of wood. It is towards fulfilling such a need that the present invention is directed.

Broadly, the present invention is embodied in modular convertible furniture systems which include a pair of similar open-ended box frame assemblies which are nestable one within the other. A pair of slotted support rails are attached pivotally at respective opposing corners of one of the box frame assemblies so as to be movable between raised and lowered positions. When in a raised position, the rails provide a support for a solid board plank thereby becoming a seat back (e.g., for a chair, love seat, or sofa-type arrangement). When the rails are in a lowered position substantially parallel to the ground, the two box frame assemblies may be oriented back-to-back so as to provide a support for a mattress thereby converting the structure into a bed arrangement, for example. The box frame assemblies can be positioned on different sides and ends thereby allowing formation of tables and/or shelving as may be desired.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein.

DETAILED DESCRIPTION OF THE INVENTION

Figure 1:
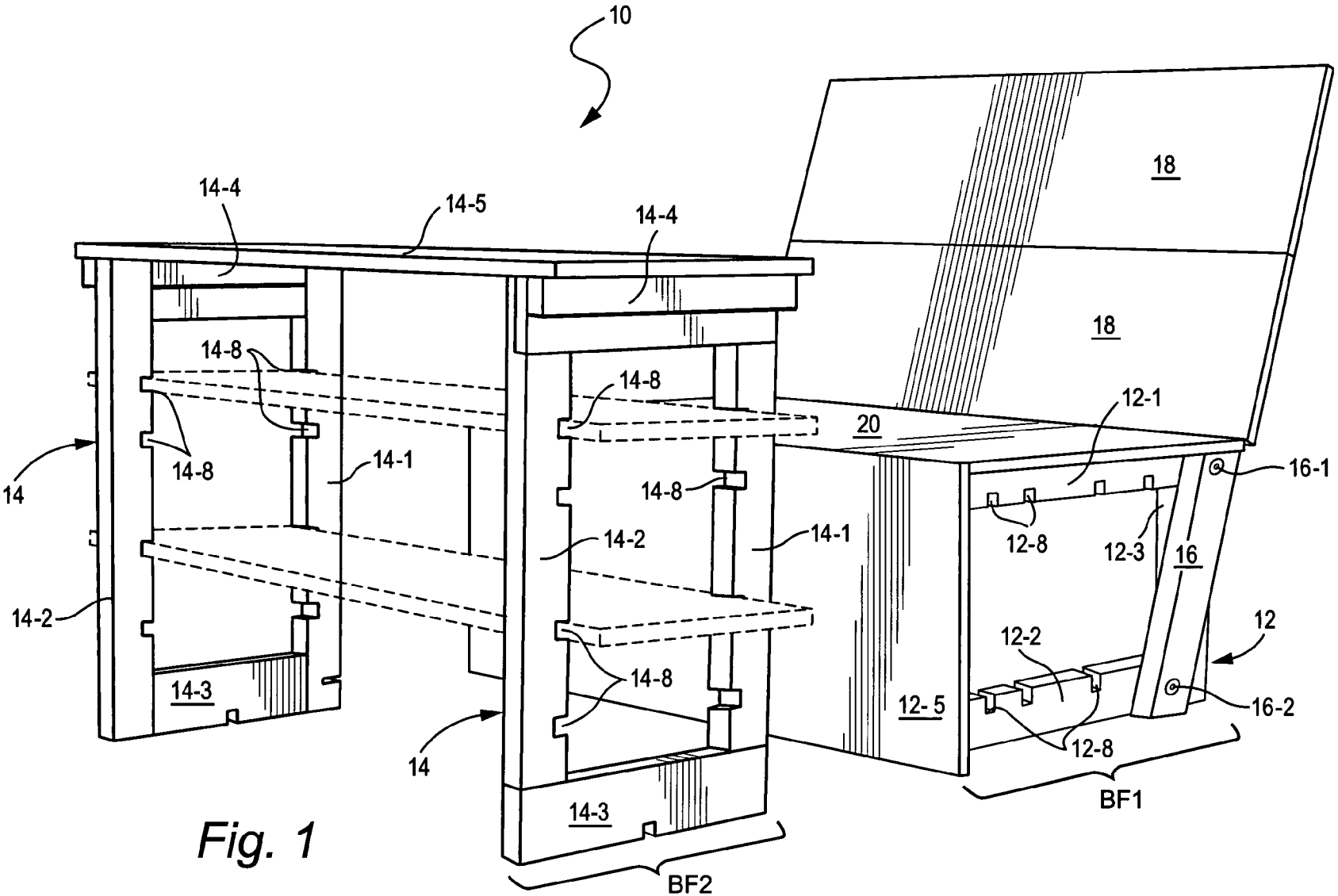
FIG. 1 is a perspective view showing the modular convertible furniture system according to this invention in the configuration of a chair/sofa and table/shelf arrangement.

Accompanying FIG. 1 depicts a particularly preferred embodiment of a modular convertible furniture frame system 10 in accordance with the present invention. As shown therein, the system 10 is comprised of primary and secondary open-ended box frame assemblies BF1 and BF2, respectively. Each of the box frame assemblies BF1 and BF2 are comprised of opposed lateral support frames 12, 14 formed of a pair of opposed pair of lateral support boards 12-1, 12-2 and 14-1, 14-2 and an opposed pair of cross-support boards 12-3, 12-4 and 14-3, 14-4, respectively, each of which is joined to adjacent ones of the boards in a conventional manner (e.g., by nails, glue, nut/bolt assemblies and/or screws).

Planking boards 12-5, 14-5 span each of the opposed lateral support frames 12, 14, respectively, and are connected to a respective one of the cross-support boards 12-4 and 14-4. In such a manner, each of the box frame assemblies BF1 and BF2 is in the form of a generally U-shape structure having an open end opposite to the planking boards 12-5, 14-5, respectively. The dimension between the opposed lateral frames 12 is however slightly less than the dimension between the opposed lateral frames 14 so as to allow the former to be nested within the latter. Preferably the difference in the dimensions between the opposed lateral frames 12 and 14 is about the width of one board, the purpose for which will be explained in greater detail below.

Figure 2:
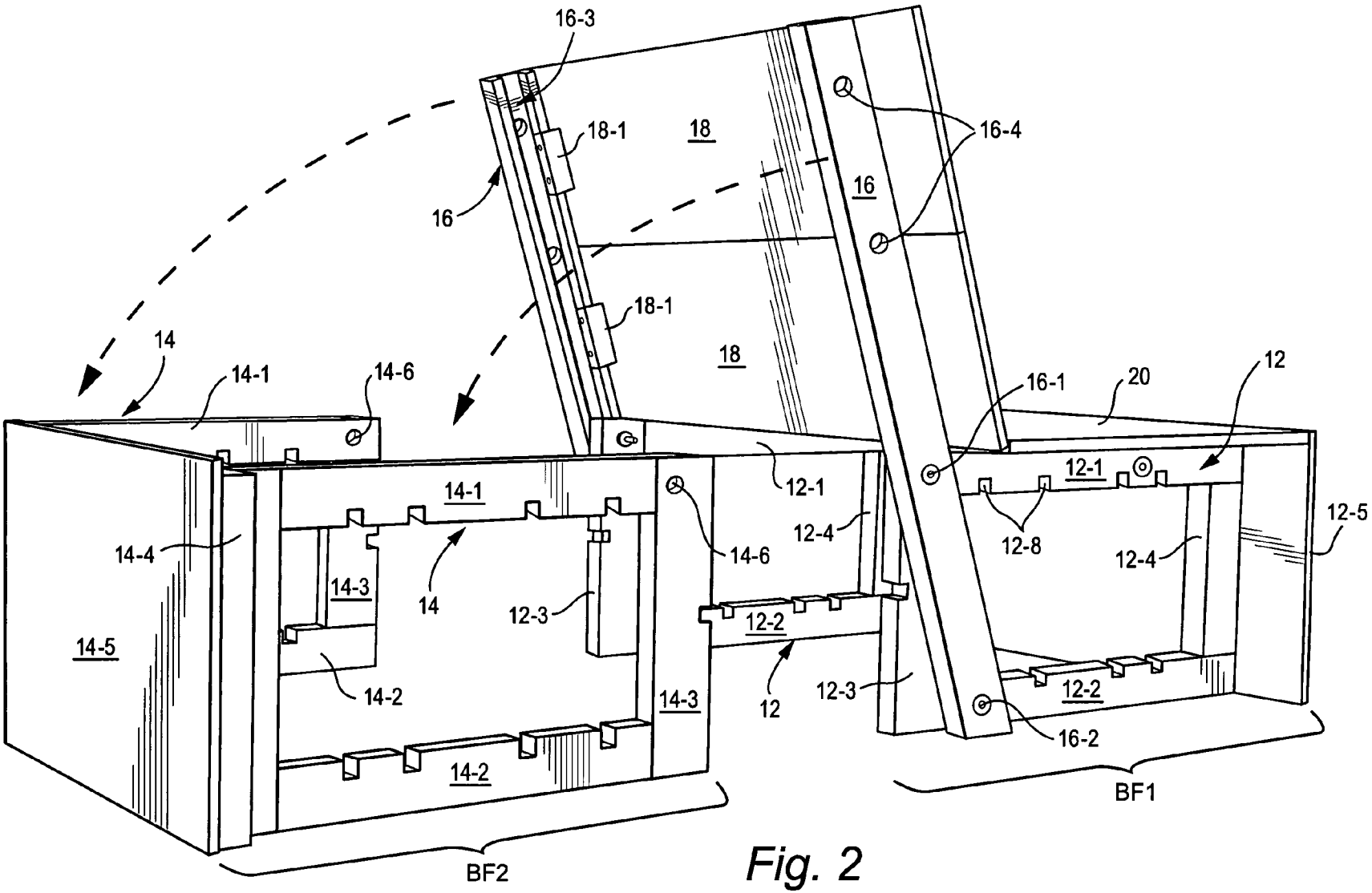
FIG. 2 is perspective view showing the manner in which the box frames of the furniture system depicted in FIG. 1 may be reconfigured into a bed arrangement.
Figure 3:
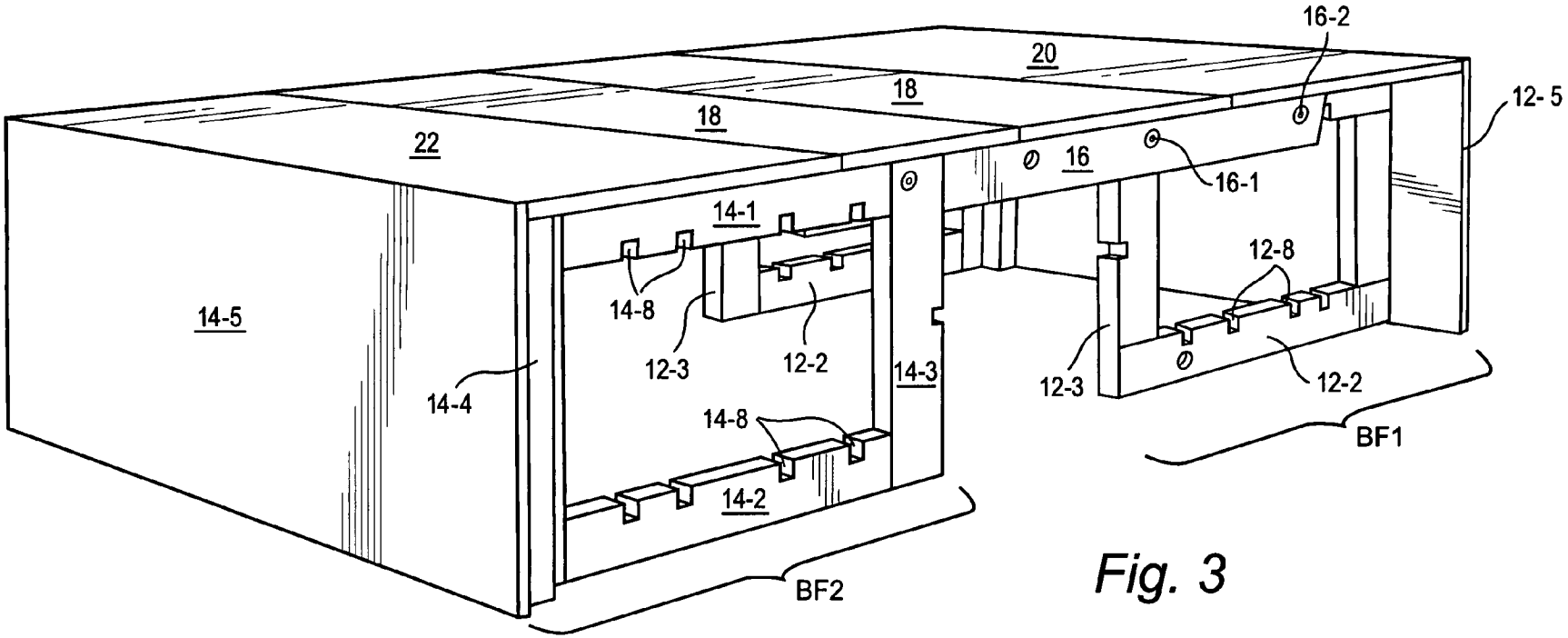
FIG. 3 is a perspective view showing the convertible furniture system of the present invention as depicted in FIG. 1, but reconfigured into a bed arrangement.

As is perhaps best seen in FIG. 2, the box frame assembly BF1 includes a pair of support rails 16 which may be pivoted about the bolted attachment point 16-1 between a raised position as shown in FIG. 2 to a lowered position as shown in FIG. 3. The support rails may be maintained in their upright raised position as shown in FIG. 2 by means of bolted attachment point 16-2 which attaches a lower end of each rail 16 to an adjacent lateral support board 12-2.

The inner surface of the support rails 16 is provided with a recessed channel 16-3 which is configured to receive an L-shaped attachment bracket 18-1 associated with spanning planks 18 (see FIG. 2). Thus, the spanning planks 18 may be positioned with respect to the support rails 16 by aligning their respective attachment brackets 18-1 with one or more channels 16-3 therein and then sliding the planks 18 into position as shown to form a seat back structure. Although not shown in the drawing FIGURES, a similar removable structural arrangement as depicted for the planks 18 may be provided for the seat plank 20. Alternatively, the seat plank 20 may be rigidly connected to the support boards 12-1 of the lateral support frames 12. The lowermost end of the support rails 16 is angled so as to determine the angular orientation as between the back planks 18 and the seat plank 20. Alternatively, of course, multiple holes to accommodate a bolt and nut arrangement may be provided in the rail 16 and support board 12-2 so as to allow user selection of the desired angular orientation between the back planks 18 and the seat plank 20.

Figure 4:
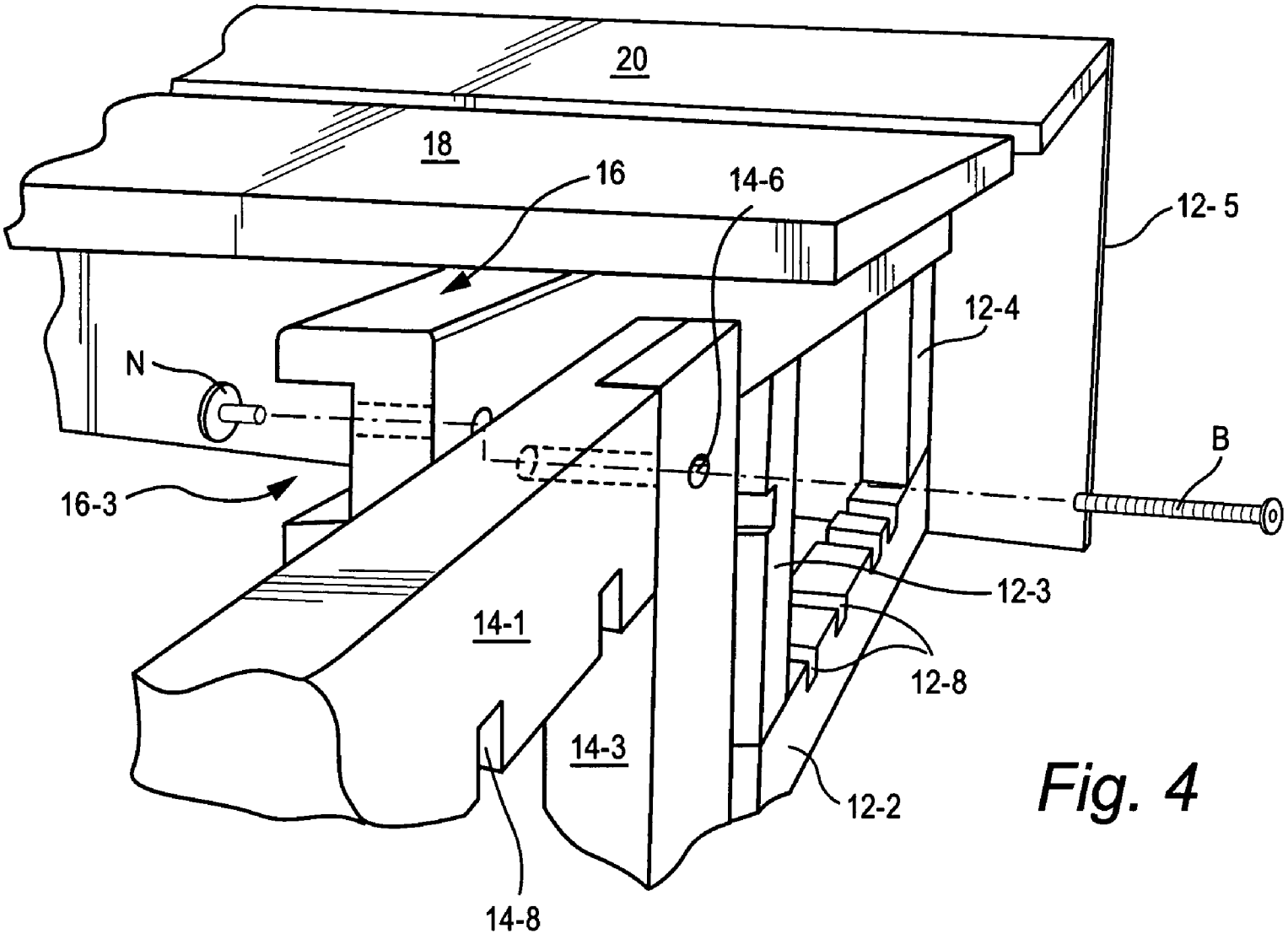
FIG. 4 is a detailed enlarged perspective view showing a preferred manner by which the components of the convertible furniture system may be removeably coupled to one another to permit ease of reconfiguration.

Upon removal of the bolt and nut arrangement from the bolted attachment point 16-2, the support rails 16 may be pivoted about the attachment point 16-1 so as to assume their lowered positions as depicted in FIG. 3. In this regard, it will be noted in FIG. 2 that each support rail has multiple holes 16-4 adapted to receive a bolt and nut arrangement when one of the holes 16-4 is aligned with a corresponding hole 14-6 associated with the lateral frames 14. Moreover, as noted previously, the dimension between the opposed lateral frames 12 is slightly less than the dimension between the opposed lateral frames 14. Most preferably, the difference in the dimensions between the opposed lateral frames 12 and 14 is about the width of the support rails 16 so that when in their lowered position, they will each be closely adjacent to the support board 14-1 as shown in FIG. 4. Thus, upon alignment with one of the holes 16-4 and the hole 14-6, a bolt and nut assembly (shown in FIG. 4 by way of example as a flathead bolt B and a blind nut N) may be positioned therein so as to secure the rails 16 to the lateral box frame 14. Placement of an auxiliary spanning plank 22 thereby completes the reconfiguration of the box frame assemblies BF1 and BF2 into a bed arrangement as shown in FIG. 3.

Those in the art will appreciate that the box frame assemblies BF1 and BF2 may be reconfigured to form a desk, shelving unit, table and the like as may be desired. For example, as shown in the accompanying drawing FIGURES, the lateral box frames 12 and 14 may be provided with opposed notches (a representative few of which are noted by reference numerals 12-8 and 14-8, respectively) so as to removeably receive a respective shelving plank 24 therein (see FIG. 1). The number of shelves may thus be preselected by the user for any given need.

Figure 5:
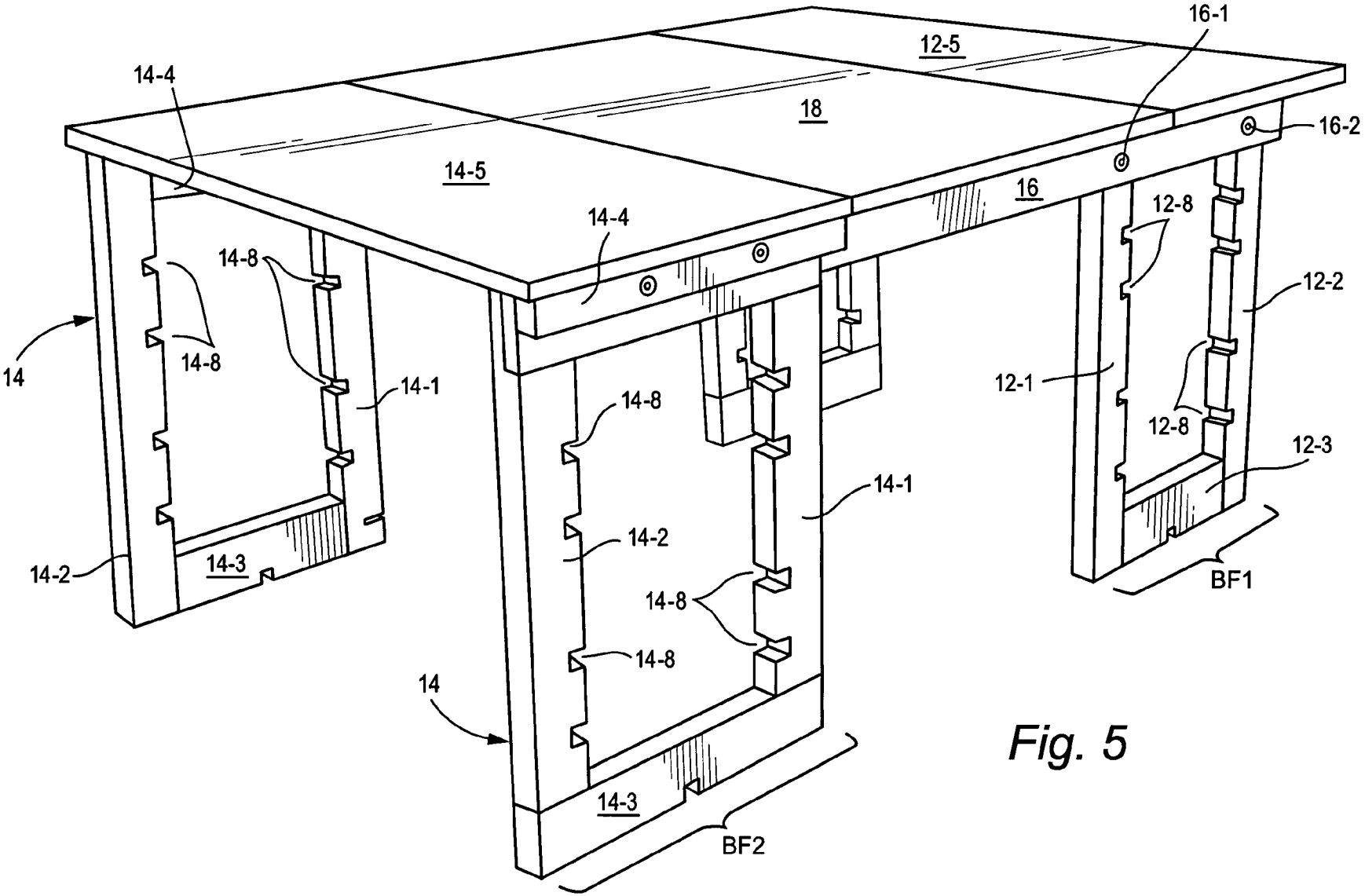
FIG. 5 is a perspective view showing the convertible furniture system of the present invention depicted in one possible table configuration.

Also, by way of example as shown in FIG. 5, the box frame assemblies BF1, BF2 may be stood on end so that their respective planking boards 12-5, 14-5 are disposed horizontally. Therefore, by connecting the support rails 16 to both the box frame assemblies BF1 and BF2 and placing a planking board 18 thereon between the boards 12-5, 14-5, a table with a horizontal table top may be configured. Of course, the size of the table top may be changed by either omitting the plank board 18 or inserting one or more other plank boards 18 as may be desired, in which case the relatively connection of the rails 16 to each of the box frame assemblies BF1, BF2 would similarly change (i.e., so as to achieve the desired lengthwise dimension of the resulting table).

As can now be appreciated, the frames of the present invention provide a user with a number of furniture configuration options which are believed to not be possible with prior art convertible furniture frames. While only a representative number of possible furniture configurations has been shown in the accompanying drawing FIGURES and described above, those in this art may recognize that the component structures of the frames could be reoriented and/or reconfigured to achieve a number of other furniture configurations.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A convertible furniture system comprising:

a pair of box frame assemblies which are sized and configured so as to be nestable one within another; and support rails attached to at least one of said box frame assemblies so as to be moveable between an upright position, wherein said support rails are capable of being fixed to said at least one box frame assembly so as to extend upwardly therefrom, and a lowered position wherein said support rails are capable of being fixed to another of said box frame assemblies so as to join said pair of box frames one to the other; wherein said one of said box frame assemblies includes at least one plank board removeably attached to and between said support rails; and wherein said support rails include lengthwise channels, and wherein said at least one plank board includes mounting brackets received slidably within said channels to allow said at least one plank board to be removeably attached to and between said support rails.

2. The convertible furniture system of claim 1, wherein each of said box frame assemblies is generally a U-shaped structure comprised of an opposed pair of lateral box frames, and a planking board spanning said opposed lateral box frames.

3. The convertible furniture system of claim 2, wherein said lateral box frames of at least the other box frame assembly comprise an opposed pair of lateral support boards and an opposed pair of cross-support boards.

4. The convertible furniture system of claim 3, further comprising shelving planks, and wherein said opposed pair of lateral support boards comprise a series of opposed notches for receiving therein a respective one of said shelving planks.

5. The convertible furniture system of claim 2, wherein said lateral box frames of each of said box frame assemblies comprise an opposed pair of lateral support boards and an opposed pair of cross-support boards.

6. The convertible furniture system of claim 5, further comprising shelving planks, and wherein said opposed pair of lateral support boards comprise a series of opposed notches for receiving therein a respective one of said shelving planks.

7. The convertible furniture system of claim 1, wherein said support rails comprise at least one hole which is capable of alignment with a corresponding hole formed in the other of said box frame assemblies when said support rails are in said lowered position thereof, and wherein said support rails are fixed to the other of said box frame assemblies by means of a bolt and nut assembly which is received within the aligned holes.

8. The convertible furniture system of claim 7, wherein said support rails comprise multiple holes to allow alignment of one said hole thereof with said hole formed in the other of said box frame assemblies to allow for length adjustment of said one and other of said box frame assemblies when joined to one another by means of said support rails.

9. The convertible furniture system of claim 1, wherein said mounting brackets are generally L-shaped.

* * * * *